US006843184B2

(12) United States Patent
Wall et al.

(10) Patent No.: US 6,843,184 B2
(45) Date of Patent: Jan. 18, 2005

(54) ADJUSTABLE DOOR BOLT JAMB FOR SAFES

(75) Inventors: Darren Wall, Payson, UT (US); Ken Stoddard, Santaquin, UT (US)

(73) Assignee: Liberty Safe and Security Products, Inc., Payson, UT (US)

( * ) Notice: Subject to any disclaimer, the term of this patent is extended or adjusted under 35 U.S.C. 154(b) by 0 days.

(21) Appl. No.: 10/371,584

(22) Filed: Feb. 21, 2003

(65) Prior Publication Data

US 2004/0163575 A1 Aug. 26, 2004

(51) Int. Cl.[7] ..... E06B 3/36

(52) U.S. Cl. ..... 109/74; 109/59 R; 109/77; 292/341.12; 292/341.18; 292/341.19

(58) Field of Search ..... 109/59 R, 74, 109/77; 292/341.12–341.19

(56) References Cited

U.S. PATENT DOCUMENTS

| | | | | | |
|---|---|---|---|---|---|
| 72,053 | A | * | 12/1867 | Levally | 292/114 |
| 232,954 | A | * | 10/1880 | Fellows | 292/341.13 |
| 361,922 | A | * | 4/1887 | Brabson | 292/239 |
| 381,329 | A | | 4/1888 | Cahill | |
| 518,453 | A | * | 4/1894 | Hollar | 292/2 |
| 522,103 | A | * | 6/1894 | Burton et al. | 109/61 |
| 522,153 | A | | 6/1894 | Damon | |
| 1,495,371 | A | * | 5/1924 | Witten | 292/238 |
| 1,624,568 | A | * | 4/1927 | Westrope | 292/341.18 |
| 1,634,814 | A | * | 7/1927 | Williams | 292/341.18 |
| 1,670,510 | A | * | 5/1928 | Kiehler | 292/341.18 |
| 1,688,626 | A | | 12/1928 | Kissinger et al. | |
| 1,715,671 | A | * | 6/1929 | Ottinger | 292/341.13 |
| 1,775,720 | A | | 9/1930 | Grable | |
| 1,794,073 | A | * | 2/1931 | Hammerl | 292/341.12 |
| 2,047,425 | A | * | 7/1936 | Menges | 292/341.12 |
| 2,217,892 | A | * | 10/1940 | Dodge | 292/341.12 |
| 2,230,409 | A | * | 2/1941 | McKenzie | 292/302 |
| 2,535,144 | A | * | 12/1950 | Miller | 292/341.18 |
| 3,287,055 | A | * | 11/1966 | Schlage | 292/341.12 |
| 3,416,829 | A | | 12/1968 | Russell et al. | 292/341.19 |
| 3,506,293 | A | * | 4/1970 | Russell et al. | 292/341.19 |
| 4,087,123 | A | | 5/1978 | Redshaw | 292/341.19 |
| 4,283,718 | A | | 8/1981 | Butler et al. | 340/545 |
| 4,483,557 | A | * | 11/1984 | Pastva | 292/218 |
| 4,492,397 | A | * | 1/1985 | Allenbaugh | 292/341.18 |
| 4,544,191 | A | * | 10/1985 | Nakama | 292/341.15 |
| 4,601,501 | A | * | 7/1986 | Pastva | 292/218 |
| 5,088,776 | A | | 2/1992 | James | 109/59 R |
| 5,341,752 | A | | 8/1994 | Hambleton | 109/59 R |
| 5,613,718 | A | * | 3/1997 | Lin | 292/346 |
| 5,784,973 | A | | 7/1998 | Mercer et al. | 109/59 R |
| 5,931,104 | A | | 8/1999 | Horn et al. | 109/59 R |
| 6,094,953 | A | | 8/2000 | Evans | 70/278.1 |

* cited by examiner

*Primary Examiner*—Suzanne Dino Barrett
(74) *Attorney, Agent, or Firm*—Thorpe North & Western, LLP

(57) ABSTRACT

A door bolt adjustment system for an open-jamb safe having a door jamb and a door bolt configured to extend behind the door jamb with a gap therebetween. The door bolt adjustment system generally comprises a substantially rigid door bolt adjuster, configured to be attached to the inside of the door jamb, and a displacement mechanism, configured to allow adjustment of the position of the door bolt adjuster so as to occupy the gap. The door bolt adjuster includes a flange for contacting a side of the extended safe door bolt, and when the adjuster occupies the gap, the flange is placed in position for secure contact with the extended door bolt, so as to accommodate the alignment of the door bolt.

18 Claims, 2 Drawing Sheets

ADJUSTABLE DOOR BOLT JAMB FOR SAFES

BACKGROUND OF THE INVENTION

1. Field of the Invention

The present invention relates generally to safes. More particularly, the present invention relates to an adjustable jamb device for securing door bolts in an open jamb-type safe.

2. Related Art

High security metal safes typically have a heavy steel door that, when closed, is secured by a series of hardened steel bolts that extend from the door into the frame of the safe surrounding the door. A recess or pocket is provided in the door frame for each of the door bolts. The door bolts are aligned with the pockets, and slide thereinto when the safe is locked. While these types of safes are very secure, they tend to be very expensive and very heavy, and are not generally suitable for a typical consumer.

Most consumers with the need for a safe are more likely to purchase a lower cost open-jamb type safe. These safes are typically fabricated of thinner steel than high security safes (i.e. sheet steel, rather than steel plates), and are intended to provide moderate security with high fire protection. The interior of the safe may include gun racks, shelves, file drawers, and other storage systems for holding various types of valuables such as cash, coins, jewels, stocks, bonds, important documents, records, electronic storage media (e.g. videotapes, floppy disks, compact disks, etc.) guns, and so forth. Gun safes of this type have become particularly popular in recent years, particularly in view of some widely publicized incidents related to unsecure storage of firearms.

Like their high security counterparts, lower cost open jamb-type safes comprise a steel case with a door that is secured closed by a series of hardened steel door bolts. However, unlike a high security safe, an open-jamb type safe simply has an inside door jamb against which all the bolts press, rather than having individual sleeves or pockets into which each bolt slides. When the bolts are extended, the door cannot open because the bolts press against the inside of the door frame.

Unfortunately, with this type of locking mechanism, open jamb-type safes present some common problems. One problem is that when the door is closed and bolted, there tends to be some flexure of the door relative to the door frame. One can actually pull on a bolted door and watch the edge of the door move outward next to the frame. This condition does not necessarily represent a functional flaw of the safe, but it is objectionable to consumers, and gives the impression of low quality goods.

This condition has several causes. Because they are not intended as high-priced, high security safes, manufacturing tolerances for low cost open jamb-type safes are generally lower than for high security safes. Consequently, the alignment of the door locking bolts may vary slightly, such that when the bolts are extended, they may not uniformly contact the inside of the door jamb. This problem is compounded by the presence of a resilient door seal strip, which allows some uniform give between the door and the door frame. To provide better and more uniform bearing, several approaches have been attempted. Some manufacturers provide a flexible steel flange along the length of the door jamb. When the bolts extend, they deflect the flange, thus providing more positive bearing for the bolts, regardless of any slight misalignment. However, a common flange for a number of bolts does not necessarily solve the problem of non-uniform bearing, because one single flange contacts all bolts, regardless of their actual alignment. Thus, the position of one bolt may deflect the flange away from contact with an adjacent bolt. Additionally, because the flange is flexible, the door flex problem remains.

Furthermore, the presence of a relatively large steel part (the common door flange) within a safe and directly connected to an inner portion of the safe cabinet presents fire resistance problems. Since metals are thermal conductors, it is important to limit the amount of exposed metal within a safe in order to promote fire and heat resistant properties. A large metal flange inside the safe will tend to aggravate this situation.

Another approach to the problem is to provide an individual flexible flange corresponding to each bolt. These can be individually bent to the correct position for contact with each bolt. While this approach addresses the misalignment problem, it does not prevent door flexure because each flange is flexible. Pulling on the door simply deflects all flanges.

SUMMARY OF THE INVENTION

It has been recognized that it would be advantageous to develop a door bolt bearing system for an open jamb-type safe that substantially prevents door flexure.

It would also be desirable to develop a door bolt bearing system for an open jamb-type safe that allows individual adjustment for the alignment of each door bolt.

The invention advantageously provides a door bolt adjustment system for an open-jamb safe having a door jamb and a door bolt configured to extend behind the door jamb with a gap therebetween. The door bolt adjustment system generally comprises a substantially rigid door bolt adjuster, configured to be attached to the inside of the door jamb, and a displacement mechanism, configured to allow adjustment of the position of the door bolt adjuster so as to occupy the gap. The door bolt adjuster includes a flange for contacting a side of the extended safe door bolt, and when the adjuster occupies the gap places the flange in position for secure contact with the extended door bolt, so as to accommodate the alignment of the door bolt.

In accordance with a more detailed aspect of the present invention, the displacement track comprises at least one elongate slot, extending through the attachment side of the door bolt adjuster, the slot configured to mate with at least one fastener disposed on the door jamb, whereby the position of the door bolt adjuster plate may be selectively adjusted along the door jamb.

Additional features and advantages of the invention will be apparent from the detailed description which follows, taken in conjunction with the accompanying drawings, which together illustrate, by way of example, features of the invention.

DETAILED DESCRIPTION

Figure 1:
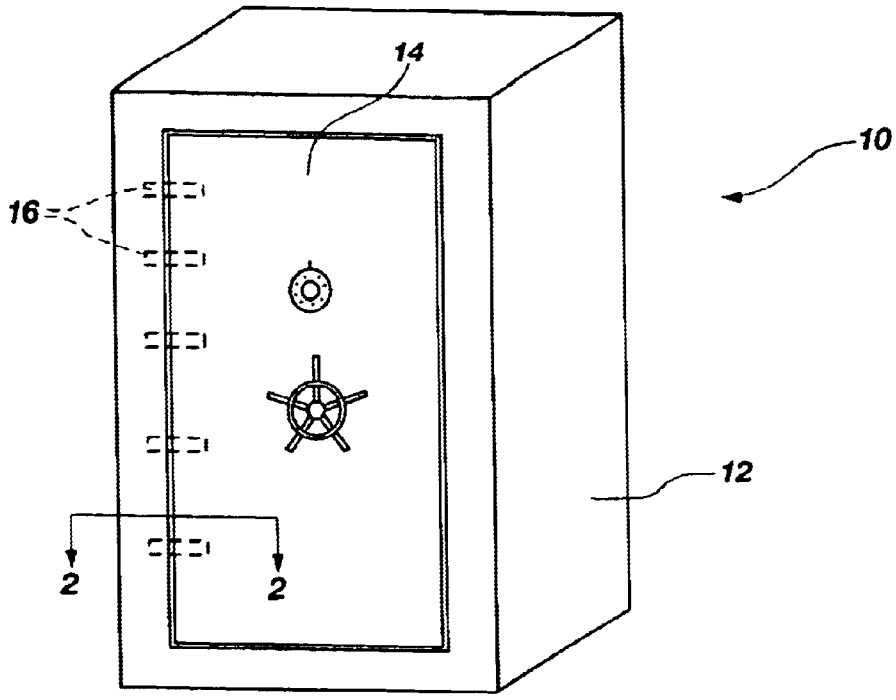
FIG. 1 is a perspective view of the exterior of a typical low cost open-jamb type safe.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein; which would occur to one skilled in the relevant art and having possession of this disclosure, are to be considered within the scope of the invention.

The present invention relates to metal safes, particularly lower cost open-jamb type safes, such as the safe 10 depicted in FIG. 1. Like their high security counterparts, lower cost open jamb-type safes typically comprise a steel case 12 with a door 14 that is secured closed by a series of door bolts 16. The interior of the safe may include gun racks, shelves, file drawers, and other storage systems for holding various types of items.

Figure 2:
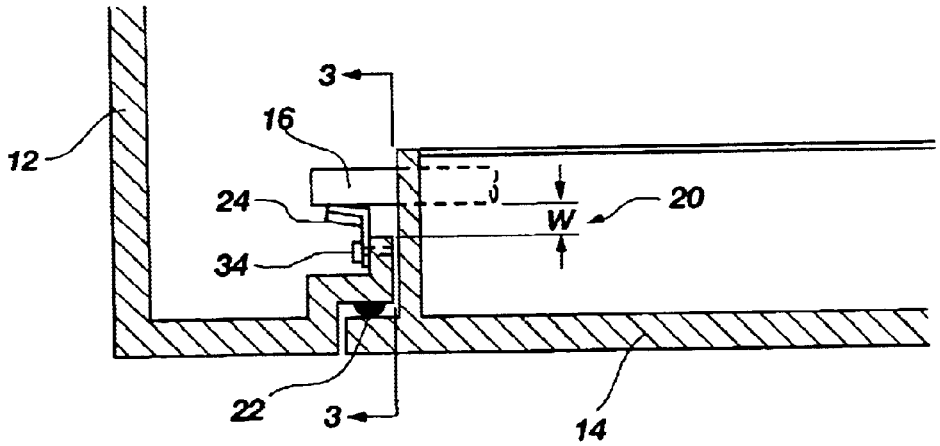
FIG. 2 is a cross-sectional view showing the safe door, door frame, and bolt bearing mechanism incorporating a door bolt adjuster according to the present invention.

With reference to FIG. 2, unlike a high security safe, an open-jamb type safe is one which, rather than having individual sleeves or pockets into which each bolt slides, simply has an inside door jamb 18 (i.e. a vertical edge of the inside of the case) against which all the bolts 16 press. When the bolts are extended, the door cannot open because the bolts press against the inside of the door frame.

Unfortunately, with this type of locking mechanism, open jamb-type safes present some common problems. One problem is that when the door is closed and bolted, there tends to be some flexure of the door 14 relative to the door frame, primarily due to slight misalignment of the door bolts 16. This misalignment produces a gap 20, between the inside edge 18 of the door jamb and the position of the extended bolt when the door is closed and properly aligned with its frame. One can actually pull on a bolted door and watch the edge of the door move outward next to the frame. This condition does not necessarily represent a functional flaw of the safe, but it is objectionable to consumers, and gives the impression of low quality goods.

This condition has several causes. Because they are not intended as high-priced, high security safes, manufacturing tolerances for low cost open jamb-type safes are generally lower than for high security safes. Consequently, the alignment of the door locking bolts may vary slightly, such that when the bolts are extended, they do not uniformly contact the inside of the door jamb. This problem is compounded by the presence of a resilient door seal strip 22, which allows some uniform give between the door and the door frame. While it is possible to tighten manufacturing tolerances to eliminate much of this misalignment, the degree of accuracy required would greatly increase the cost of these safes.

To provide better and more uniform bearing, several approaches have been attempted. Some manufacturers provide a continuous flexible steel flange along the length of the inside of the door jamb. When the door bolts extend, they deflect the flange, thus providing more positive bearing for the bolts, regardless of slight misalignment. However, a common flange for a number of bolts does not necessarily solve the problem of non-uniform bearing, because one single flange contacts all bolts, regardless of their actual alignment. Thus, the position of one bolt may deflect the flange away from contact with an adjacent bolt. Additionally, because the flange is flexible, the door flex problem remains.

Furthermore, the presence of a relatively large steel part (the common door flange) within a safe and directly connected to an inner portion of the safe cabinet presents fire resistance problems. Since metals are thermal conductors, it is important to limit the amount of exposed metal within a safe in order to promote fire and heat resistant properties. A large metal flange inside the safe will tend to aggravate this situation.

Another approach to the problem is to provide an individual flexible flange corresponding to each bolt. These can be individually bent to the correct position for contact with each bolt. While this approach addresses the misalignment problem, it does not prevent door flexure because each flange is flexible. Pulling on the door simply deflects all flanges.

The present invention helps overcome the problems of the prior art by providing a door bolt bearing system for an open jamb-type safe that substantially prevents door flexure and allows individual adjustment for the alignment of each door bolt. Viewing FIGS. 2-4, in one embodiment the invention comprises a substantially rigid door bolt adjuster plate 24 that attaches to the inside of the door jamb 18 adjacent to each bolt 16. The adjuster plate comprises a bent metal plate having an attachment side 26 for attaching to the door jamb, and a flange side 28 configured for contacting a door bolt. Viewing FIG. 4, the bend angle $\theta$ between the attachment side and the flange side is preferably slightly more than about 90°. It can be within about 10° of perpendicular, but an angle of about 95° is most preferred. This angle provides slight spring-like resistance against an extended door bolt. The flange is also oriented at an angle, as will be described in more detail below. The adjuster plate may be made of grade 301 stainless steel of about 0.0359" thickness to provide adequate stiffness and rigidity. This configuration provides secure bearing against an extended door bolt, yet also flexes slightly when the door bolt presses into the bend angle. However, other materials of differing thicknesses may also be used. For example, other grades of steel, including nonstainless steel, plastic, and other durable materials may also be used.

Figure 3:
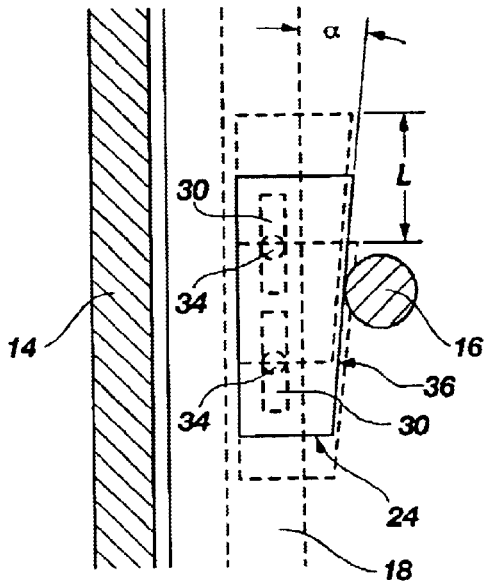
FIG. 3 is a cross-sectional view of the door jamb and adjuster shown in FIG. 2.
Figure 4:
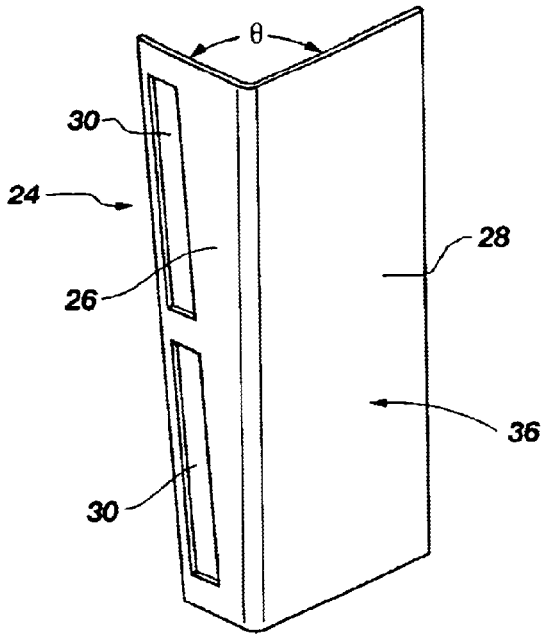
FIG. 4 is a perspective view of the door bolt adjuster shown in FIGS. 12 and 3.

The adjuster plate 24 and door jamb 18 comprise a displacement track, whereby the position of the flange 28 relative to the door jamb may be adjusted by moving the adjuster plate relative to the door jamb before tightening it on the door jamb. In the embodiment of FIGS. 3 and 4, the displacement track comprises two elongate slots 30, disposed in end-to-end relationship along a common axis on the attachment (or vertical) side 26 of the adjuster plate. The elongate slots are configured to mate with fasteners 34, such as bolts, screws, etc., associated with the door jamb.

The displacement track is preferably configured with a maximum displacement length L at least as great as the width W of the gap 20 between the door bolt 16 and the door jamb 18. The extreme positions of the adjuster plate 24 relative to a single door bolt are shown in dashed lines in FIG. 3. The flange 28 is oriented at an angle $\alpha$ relative to the displacement track (also the common axis of the elongate slots 30), so as to provide a slanted face 36. This angle may vary, but is preferably from about 5° to about 20°. The benefit of this configuration is that when the adjuster plate is moved linearly (i.e. vertically) along the displacement track (the common axis of the slots) before tightening the fasteners, the slanted face 36 of the flange 26 translates laterally to fill the gap 20 between the door bolt 16 and the door jamb 18. Once tightened in place, the adjuster plate provides a secure bearing surface for the extended door bolt. In other words, by sliding the adjuster vertically, up or down, the point of contact of the flange with the bolt moves laterally. The result is that the bearing of each bolt can be individually adjusted, and when the door is bolted, there is little or no flex because of the rigidity of the adjuster plate.

Figure 5:
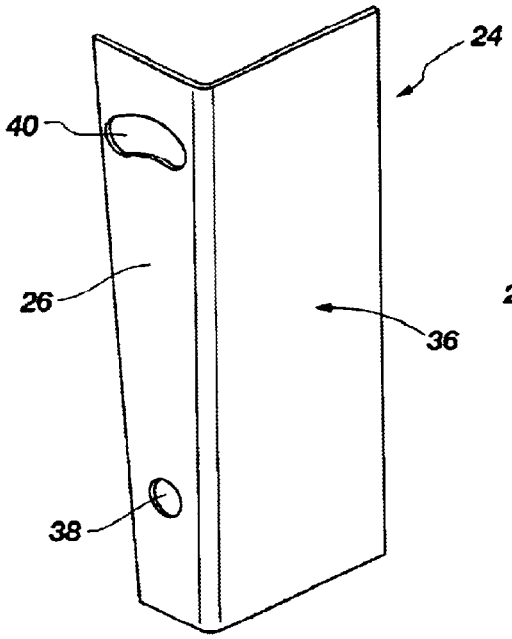
FIG. 5 is a perspective view of an alternative door bolt adjuster configured for use in accordance with the present invention.
Figure 6:
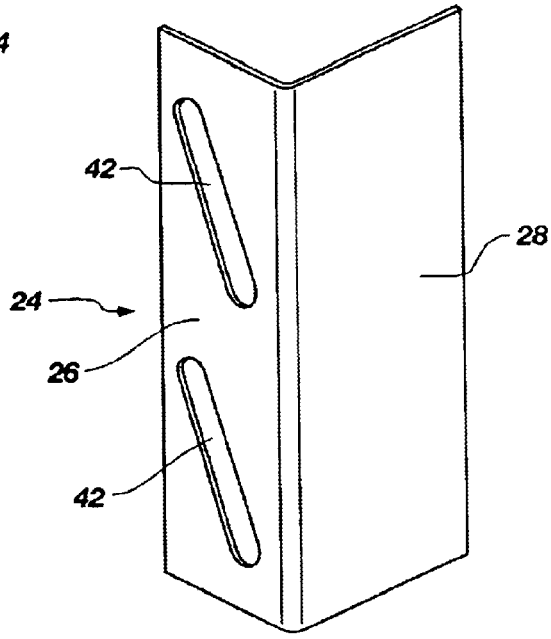
FIG. 6 is a perspective view of yet another alternative door bolt adjuster configured for use in accordance with the present invention.

The adjuster plate 24 may be configured in a variety of ways. It will be apparent that, rather than two aligned linear slots (28 in FIG. 4), the adjuster plate may comprise just one elongate slot through which one or more fasteners may extend. Alternatively, as shown in FIG. 5, the adjuster plate may comprise a mounting hole 38 and an arcuate slot 40 disposed in the attachment side 26 of the adjuster plate. The mounting hole is configured to mount over a first fastener 34, while the arcuate slot fits over a second fastener 34. The arcuate slot defines a circular arc with the mounting hole defining the center point of the arc. This arrangement allows the adjuster plate to pivot on the first fastener, while sliding the second fastener along the arcuate slot, so as to adjust the position and angle of the flange 26 and its slanted face 36 relative to the displacement track. Once the flange is in the desired position, so as to provide positive bearing against the associated door bolt, the first and second fasteners can then be tightened.

As yet another alternative, the adjuster plate 24 may be configured without a slanting face, and instead comprise a pair of parallel elongate slots 42 slantingly disposed on its attachment side 26. These slots are configured to mate with two fasteners 34 disposed on the door jamb, such that the position of the slanted face 36 of the flange 26 relative to the door jamb 18 may be linearly adjusted along a slanted path relative to an edge of the door jamb by sliding the adjuster along the two fasteners. This will translate the position of the flange either toward or away from the door jamb, without rotating it. Once the flange is in the desired position, so as to provide positive bearing against the associated door bolt 16, the fasteners in each slot can then be tightened.

It will be apparent that other variations in the design of the door bolt adjustment system are possible. For example, rather than providing slots in the adjuster plates and attaching the fasteners to the door jamb, the configuration may be reversed, with the fasteners attached to the adjuster plate, and slots disposed in the door jamb. Alternatively, slots could be provided in both the adjuster plate and the door jamb, with separate fasteners extending through both.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A safe, comprising:

a. a safe body, having a door jamb;

b. a door, hingedly attached to the safe body, having a door bolt configured to extend behind the door jamb, with a gap between the door bolt and the door jamb; and c. a substantially rigid door bolt adjuster plate, configured to be connected to the door jamb, comprising a one-piece bent plate having an attachment side for attaching to the door jamb, and a flange side configured for contacting the door bolt, the adjuster plate having a displacement track with a length at least as great as the gap, the adjuster plate configured to variably contact a side of an extended door bolt in a position in proportion to displacement of the plate along the track, so as to occupy the gap between the door bolt and the door jamb, to thereby provide a secure bearing surface for the extended door bolt.

2. A safe in accordance with claim 1, wherein the displacement track comprises at least one elongate slot extending through the attachment side of the door bolt adjuster plate, configured to mate with at least one fastener disposed on the door jamb, whereby the position of the door bolt adjuster plate may be selectively adjusted along the door jamb.

3. A safe in accordance with claim 2, wherein the displacement track comprises two elongate slots, disposed in end-to-end relationship along a common axis on the attachment side, configured to mate with two fasteners disposed on the door, whereby the position of the flange relative to the door jamb may be adjusted by moving the adjuster linearly along the common axis of the slots before tightening the fasteners.

4. A safe in accordance with claim 2, wherein the displacement track comprises:

a. first and second fasteners disposed on the door jamb;

b. a mounting hole, disposed in the attachment side of the adjuster plate and configured to mate with the first fastener, such that the adjuster plate may pivot thereabout; and c. an arcuate slot, disposed in the attachment side of the adjuster plate and configured to mate with the second fastener, such that the position of the flange relative to the door jamb may be adjusted by pivoting the adjuster about the first fastener while sliding the second fastener along the arcuate slot, so as to adjust an angle of the flange relative to the displacement track before tightening the first and second fasteners.

5. A safe in accordance with claim 2, wherein the displacement track comprises two parallel elongate slots, slantingly disposed on the attachment side, configured to mate with two fasteners disposed on the door, whereby the position of the flange relative to the door jamb may be linearly adjusted along a slanted path relative to an edge of the door jamb by sliding the adjuster along the two fasteners before tightening the fasteners.

6. A safe in accordance with claim 1, wherein the bent plate comprises a bend angle of 90° plus or minus about 10°.

7. A safe in accordance with claim 1, wherein the bend angle is about 95°.

8. A safe in accordance with claim 1, wherein the flange side is disposed at an angle relative to the displacement track.

9. A safe in accordance with claim 8, wherein the angle is from about 5° to about 20°.

10. A safe in accordance with claim 1, wherein the door bolt adjuster plate is of a material selected from the group consisting of steel, stainless steel, and plastic.

11. A door bolt adjustment system for an open-jamb safe having a door jamb and a door bolt configured to extend behind the door jamb with a gap therebetween, comprising:

a. a substantially rigid door bolt adjuster, configured to be attached to the inside of the door jamb, comprising a one-piece bent plate having an attachment side for attachment to the door jamb, and a flange for contacting a side of the extended safe door bolt; and b. a displacement mechanism, configured to allow adjustment of the position of the door bolt adjuster so as to occupy the gap and place the flange in position for secure contact with the extended door bolt, so as to accommodate the alignment of the door bolt.

12. A system in accordance with claim 11, wherein the displacement mechanism comprises at least one fastener disposed on the door jamb, and at least one slot extending through the attachment side of the metal plate, whereby the position of the door bolt adjuster may be selectively adjusted along the door jamb.

13. A system in accordance with claim 12, wherein the displacement mechanism comprises two elongate slots disposed on the attachment side, configured to mate with two fasteners disposed on the door jamb, whereby the position of the flange relative to the door jamb may be adjusted by moving the adjuster linearly along the fasteners before tightening the fasteners.

14. A system in accordance with claim 13, wherein the two elongate slots are disposed in end to end relationship along a common axis, such that the position of the flange relative to the door jamb may be adjusted by moving the adjuster linearly along the fasteners before tightening the fasteners.

15. A system in accordance with claim 13, wherein the two elongate slots are parallel and slantingly disposed on the attachment side, such that the position of the flange relative to the door jamb may be linearly adjusted along a slanted path relative to an edge of the door jamb by sliding the adjuster along the two fasteners before tightening the fasteners.

16. A system in accordance with claim 12, wherein the displacement mechanism comprises:

a. first and second fasteners disposed on the door jamb;

b. a mounting hole, disposed in the attachment side of the adjuster plate and configured to mate with the first fastener, such that the adjuster plate may pivot thereabout; and c. an arcuate slot, disposed in the attachment side of the adjuster plate and configured to mate with the second fastener, such that the position of the flange relative to the door jamb may be adjusted by pivoting the adjuster about the first fastener while sliding the second fastener along the arcuate slot, so as to adjust an angle of the flange relative to the displacement track and increasing a distance of the flange from the door jamb before tightening the first and second fasteners.

17. A safe, comprising:

a. a safe body, having a door jamb;

b. a door, hingedly attached to the safe body, having a door bolt configured to extend behind the door jamb with a gap between the door bolt and the door jamb; and c. a substantially rigid door bolt adjuster plate, comprising a one-piece bent plate having an attachment side and a flange, the attachment side being configured to be attached to an inside of the door jamb, and the flange being configured to contact the door bolt, the adjuster plate having a displacement range with a length at least as great as the gap, configured to cause the flange to variably contact a side of the extended door bolt in proportion to the displacement of the plate along the path, so as to occupy the gap between the door bolt and the door jamb and thereby substantially prevent outward flexure of the safe door when the door bolt is extended.

18. A method for providing secure contact of a safe door bolt with a door jamb of an open-jamb safe where a gap exists between the door jamb and the door bolt when extended, comprising the steps of:

a. providing a substantially rigid door bolt adjuster, comprising a one-piece bent plate having an attachment side for attaching to the door jamb, and a flange for contacting a side of the extended safe door bolt;

b. attaching the attachment side of the door bolt adjuster to an inside of the door jamb of the safe during manufacture of the safe;

c. displacing the door bolt adjuster along the door jamb so as to cause the flange to occupy the gap and to securely contact the side of the extended door bolt; and d. securing the door bolt adjuster to the door jamb during manufacture of the safe.

* * * * *